United States Patent [19]

Brockner et al.

[11] 4,244,404

[45] Jan. 13, 1981

[54] ROTARY PISTON FILLER

[75] Inventors: Bruce A. Brockner; Rand R. Caspersen, both of New Richmond, Wis.

[73] Assignee: Domain Industries, Inc., New Richmond, Wis.

[21] Appl. No.: 11,179

[22] Filed: Feb. 12, 1979

[51] Int. Cl.[3] ..... B67C 3/28; B65B 3/12

[52] U.S. Cl. ..... 141/146; 141/152; 222/168.5

[58] Field of Search ..... 141/115, 146, 145, 144, 141/143, 142, 141, 147, 148, 149, 150, 151, 152; 222/168.5, 189, 305, 306, 309, 387, 366, 444, 571; 137/625.68; 251/324

[56] References Cited

U.S. PATENT DOCUMENTS 3,580,302 5/1971 Risenberg ..... 141/152

*Primary Examiner*—Houston S. Bell

*Attorney, Agent, or Firm*—H. Dale Palmatier

[57] ABSTRACT

A rotary piston filler with a plurality of cylinders and pistons around the periphery of the turret to fill containers rotating with the turret, a circumferential cam bar surrounding the turret, a cam follower following the cam bars and producing reciprocation of the piston, a lost motion connection between the cam follower and the piston in the connection for varying the magnitude of throw in the reciprocating movement of the piston.

9 Claims, 3 Drawing Figures

ROTARY PISTON FILLER

This invention relates to filling equipment for bottles, jars and cans which are to be filled with a liquid type material in a production line.

BACKGROUND OF THE INVENTION

Containers of various sorts including bottles and cans and jars, etc., are commonly filled with liquid type products in a production line by a rotary type piston filler wherein the containers arrive on a conveyor line and are successively applied onto a turret in underlying relation with a revolving piston type filler. The filler has a piston moving in an upright cylinder, and the piston is reciprocated upwardly and downwardly during revolving of the filler and turret so that the liquid product is drawn into the piston and is subsequently expelled from the piston into the container being filled. The amount of liquid product that is supplied into the container in the filling operation is measured by the magnitude of the piston movement in the cylinder, and the size of the cylinder.

The vertical reciprocation of the pistons is conventionally controlled by a cam follower or roller moving between circumferential or belt type cam bars having somewhat of an undulating shape in a direction along the turret axis, while at all locations being equidistance from the turret axis to permit the cam follower or roller to be continuously confined between the two guide rails.

In the past, it has been conventional to adjust the quantity of liquid drawn into the pistons by tipping or adjusting the magnitude of the undulation in the cam rails surrounding the rotating filling machine. This technique simultaneously adjusts the quantity of liquid filled into all the cylinders, and all the containers being filled. However, because of the accuracies demanded by governmental authorities, and in order to give the customers of the liquid product their full measure, this type of control of the measuring of the liquid product has proved unsatisfactory. In order to make sure that an adequate amount of liquid product is supplied into the container, the adjustment tends to overfill certain of the containers if there is any minute difference between the quantities drawn and expelled from the piston fillers.

In the prior art apparatus there is no provision made for compensating between variations in sizes as between adjacent cylinders on the turret. A variation in cylinder diameter in the range of 0.003 to 0.004 inches can make a significant difference in the quantity of liquid product being measured. Likewise, the seals between the pistons and the cylinders need changing from time to time, and variations in the seals as between new seals and old seals and possibly in redesigned seals to produce a sealing effect on various types of liquids can have a significant effect upon the internal volume of the cylinder into which the liquid product is drawn. The prior art filling machines have made no provision at all for making fine adjustments to compensate for the sizes of the cylinders and the volume of the chambers defined thereby, and likewise, there is no possibility in the prior art apparatus for adjusting for any possible leakage that might conceivably occur on a temporary basis.

SUMMARY OF THE INVENTION

It is a principal object of the invention to provide a rotary piston filler for containers moving in a production line which is capable of varying or adjusting the quantity of liquid product dispensed by each individual cylinder and piston as the several pistons are revolved and controlled by the shape of a single stationary cam bar.

A principal feature of this invention is the provision of a lost motion connection between the cam follower and the corresponding piston so that a variation in the amount of pumping effected by the filler can be accomplished by adjusting the amount of lost motion.

The lost motion connection between the cam follower and the piston is provided in the disclosure according to the present invention at a slide bearing which connects the piston rod and the vertically moving drive arm which connects the cam follower or roller to the piston rod. On the piston rod, there is an adjustable nut which retains the drive arm of the cam follower on the piston rod. The retaining nut may be turned along the piston rod so as to clamp the drive arm tightly to the piston rod. Under this condition, the stroke of the piston is equal to the stroke of the drive arm of the cam follower.

When the retaining nut is adjusted so as to allow some lost motion between the drive arm and the piston rod, the drive arm of the cam follower will commence its vertical movement under influence of the two guide rails or bars, and initially the piston will remain stationary and will, momentarily, not be permitted to draw liquid product into the cylinder. After the drive arm has incrementally moved, it will commence drawing the piston rod and piston upwardly to commence filling the cylinder. However, because of the momentary delay of the piston, the amount drawn into the cylinder will be slightly less than what might otherwise be drawn, had the retainer nut been turned down tightly onto the drive arm of the cam follower. In this way, the quantity of liquid product pumped by each piston and cylinder may be varied so that each of the pistons on the turret can be adjusted to pump to fill the precise measure of liquid product desired to be expelled into the container being filled.

Accordingly, the present invention allows individual adjustment at each of the cylinders to compensate for such variables as the consistency or viscosity of the liquid product being pumped, small variations in the actual size between adjacent cylinders, any possible wear at the seals which may change the quantity of the volume of liquid product being pumped, and any possible leakage in isolated instances. Of course, these accommodations provided by the present invention make it possible to reduce the accuracy requirements which would otherwise be imposed in the manufacturing, particularly in relation to cylinder sizes, consistency of seals, selection of materials used in the cylinders and pistons. In addition, down time of the filling machine can be minimized because of the simplicity and ease of adjusting the measuring capability of individual cylinders.

BRIEF DESCRIPTION OF THE DRAWINGS

FIG. 2 is an enlarged detail section view taken on a vertical plane approximately at 2—2 in FIG. 1; and FIG. 3 is a detail section view taken approximately at 3—3 in FIG. 2.

DETAILED SPECIFICATION

Figure 1:
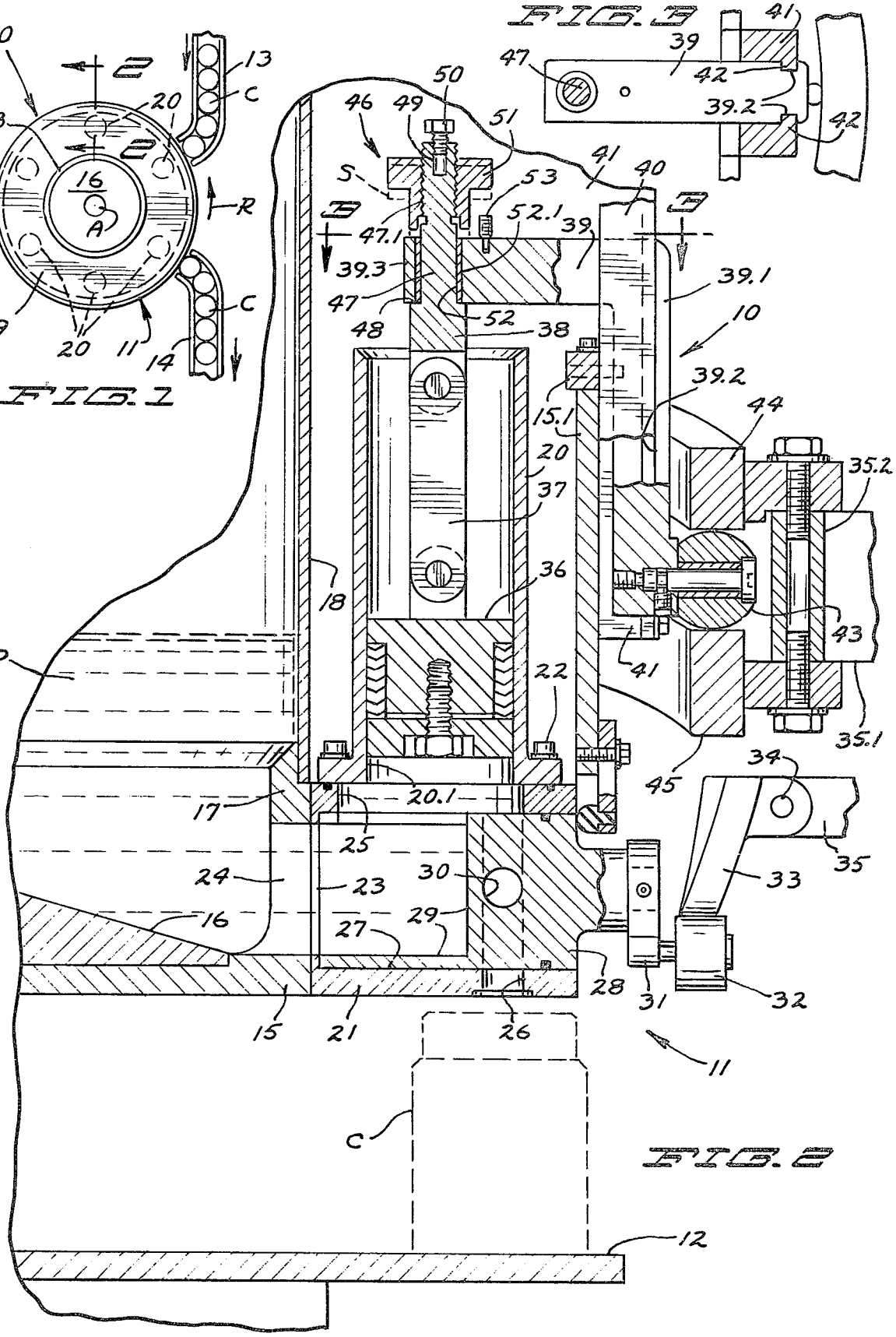
FIG. 1 is a top plan view of the rotary piston filler.

One form of the invention is shown in the drawings and is described herein. The rotary piston filler is indicated in general by numeral 10 and includes a rotary turret indicated in general by numeral 11 and rotatably driven about a substantially vertical axis A in the direction of arrow R. The turret 11 includes a container-carrying platen assembly 12 receiving containers C from a line conveyor 13 and then carrying the containers around the turret for subsequent discharge onto a second conveyor 14 which carries the containers away from the turret after they have been filled.

The turret 11 has a rotary frame 15 which defines a central reservoir 16 for the liquid product P. The peripheral sidewall 17 of the reservoir has an elongate upstanding wall extension 18 with an outwardly flared hopper-like upper portion 19 which facilitates directing the liquid product P into the reservoir 16.

The frame 15 of the turret carries a plurality of liquid product measuring and dispensing cylinders 20 spaced about the periphery thereof. The several cylinders 20 and their related assemblies are substantially identical to each other and an understanding of one of the cylinders as illustrated in FIGS. 2 and 3 will suffice for an understanding of all of the liquid product measuring cylinders.

At each of the measuring cylinders 20, a valve housing 21 is affixed to the turret frame 15 in stationary relation and also serves to mount the cylinder 20, as by bolts 22. The valve housing 21 has an open inner end 23 communicating with a supply port 24 in the peripheral wall 17 of the reservoir.

The valve housing 21 also has an enlarged opening or port 25 communicating with the open interior 20.1 of the cylinder at the lower end thereof. A discharge port 26 at the lower side of the valve housing 21 is aligned with the container C on the turret plate 12 for directing liquid product from the valve into the container C.

The valve housing 21 has a cylindrical interior bore 27 in which the valve rotor 28 is confined. The rotor has an inlet port 29 and a discharge port 30 oriented at 90 degrees with respect to each other to control the flow of liquid product P into and out of the cylinder chamber 20.1. In the position shown, the port 30 is turned out of communicating relation with the ports 25 and 26 of the valve housing, but in this position, the port 29 of the valve rotor is in communicating relation with the inlet port 23 and the cylinder port 25 to provide flow communication between the reservoir 16 and the cylinder chamber 20.1 to facilitate filling of the cylinder chamber. The rotor 28 may be rotated 90 degrees to turn the port 29 out of communicating relation with port 25 and to turn the port 30 into communicating relation with the two ports 25 and 26 of the valve housing to thereby connect the cylinder chamber 20.1 directly to the discharge port 26 and thereby direct the liquid product into the container C.

Rotation of the valve rotor 28 is controlled by an arm 31 with a cam following roller 32 thereon controlled by positioning cams 33 at spaced locations about the periphery of the turret so as to orient the rotor 28 to the correct orientation for supplying liquid product into the cylinder and then dispensing the liquid product into the container at various portions of the rotary cycle as the turret revolves.

The cam 33 is mounted by a pivot 34 to the stationary frame 35 of the machine which is stationary with respect to the revolving turret 11. The cam 33 may be swung out of operating position so as to avoid engaging the roller 32 if it is desired to retain the rotor 28 in stationary condition, as in the case of a missing container on the turret plate 12.

Each of the cylinders 20 contains a piston 36 in the cylinder chamber 20.1 for pumping quantities of the liquid product P. The piston 36 is connected by a swingable link 37 to a piston rod 38 which extends substantially vertically from the top end of the cylinder 20.

Vertical reciprocation of the piston 36 and piston rod 38 is produced, during each revolution of the turret 11 by a drive arm 39 which reciprocates vertically between a pair of guide tracks 40 and 41. The drive arm 39 has an upright portion 39.1 with elongate upright grooves 39.2 therein to receive and follow the inwardly turned flanges 42 of the tracks 41 and 40. The upright tracks 40 and 41 revolve with the turret 11 and are rigidly interconnected with each other and with the frame plate 15 of the turret by the upright frame bars 15.1.

The drive arm 39 adjacent each of the cylinders 20 has a cam follower roller 43 carried on the lower end thereof to follow along and between a pair of elongate stationary circumferentially extending cam bars 44 and 45 which embrace the entire turret 11 and which are rigidly mounted in stationary condition on another portion of the frame 35.1 of the machine. The cam bars 44 have an undulating shape in the axial direction of the turret axis A so as to produce vertical reciprocation of the drive arm 39 as the turret revolves. Precise and predetermined spacing between the cam bars 44 and 45 is maintained by the spacer structure 35.2 associated with the frame 35.1.

Reciprocating motion is transmitted from the drive arm 39 to the drive rod 38 by a lost motion connection which is indicated in general by numeral 46. The lost motion connection is defined by an elongate upright stem 47 on the upper end of the drive rod 38. The stem 47 is of a reduced transverse size as compared to the main portion of the drive rod 38 and accordingly the drive rod 38 has shoulders 48 thereon. The upper portion 47.1 of the stem 47 is threaded, and is provided with an endwise extending slot 49 into which a cap screw 50 is turned. The threaded upper end of the stem 47 has a stop nut 51 threaded thereon so as to be adjustable along the stem 47 and to the dotted line position S as illustrated. The position of the nut 51 is releasably fixed on the stem 47 by the cap screw 50 which spreads the ears adjacent the slot 49 and thereby causes a jamming relationship with the nut 51.

The end portion 39.3 of the drive arm 39 has a vertically oriented bore 52 therein receiving the stem 47 in sliding relation. The bore 52 may carry a sleeve type bushing 52.1 for engaging the stem 47.

A limiting stop 53 is fixed to the arm 39 in confronting relation with the flange portion of nut 51.

In operation, the turret will revolve about the axis A, so as to progressively move the pistons 20 circumferentially around the turret. As the cam follower 43 moves between the cam bars 44 and 45, the drive arm 39 is reciprocative along the tracks 40 and 41 so as to reciprocate the piston 36 in the cylinder; which causes liquid product P to be drawn from the reservoir into the cylinder chamber, and then after the valve rotor 28 is turned to its alternate position, the liquid product is discharged through the ports 30 and 26 into the container.

The lost motion connection 46 provides adjustability at each of the cylinders 20 so as to minutely vary the quantity of liquid being pumped by each particular cylinder 20.

As the drive arm 39 initially moves upwardly from the full line position shown, the drive rod 38 and piston 36 will momentarily remain stationary, until the drive arm 39 engages the nut 51, whereupon the drive rod 38 and piston 36 will be put into motion in an upward direction for the purpose of drawing liquid from the reservoir into the cylinder chamber.

After the upward stroke of the drive arm 39 is completed, under the control of the cam bars 44 and 45, the downward stroke of the drive arm 39 is commenced, and the drive rod 38 and pistons 36 will temporarily remain stationary, and during this moment, the drive arm 39 will move downwardly away from the nut 51 and will reengage the shoulder 48 on the drive rod. Thereafter, as the drive arm 39 is moved downwardly under the influence of the cam bars 44 and 45, the piston 36 is moved downwardly to expel liquid product through the port 30 after the valve rotor 28 has been turned and through the port 26 for dispensing into the container C.

If the nut 51 is adjusted upwardly so as to increase the spacing between the nut and the end portion 39.3 of the drive arm, there will be a longer momentary delay between the commencing of upward movement of the drive arm to the commencing of upward movement of the piston 36, whereupon the overall magnitude of upward movement of the piston 36 will be significantly reduced.

On the other hand, if the nut 51 is turned along the stem 47 downwardly closer to the upper end 39.3 of the drive arm, the momentary delay between the commencing of upward movement of the drive arm and the commencing of upward movement of the piston 36 will be materially reduced so that the overall magnitude of reciprocating stroke of the piston 36 is increased, thereby pumping a greater portion of liquid product in each cycle of the piston.

In some instances, it may be desirable to maximize the pumping at a particular cylinder 20 by turning the nut 51 entirely down so as to engage the nut onto the upper end 39.3 of the drive arm and clamp the drive arm securely against the shoulder 48. Under these conditions, the quantity of liquid product dispensed in each stroke of the piston is maximized.

Accordingly, it will be seen that the precise quantities of liquid product P pumped and measured by a cycle of each of the cylinders 20 may be accurately controlled so that the precise desired measure of liquid product dispensed into the container C can be carefully controlled. As the nature of the liquid product being dispensed is changed, as to viscosity or other characteristics, the actual pumping characteristics of the several cylinders will be changed accordingly so that a full measure can be dispensed into the container C.

It will be seen that the present invention includes in the drive connection between the undulating cam bars 44 and 45 and the piston 36, the lost motion connection 46 which permits the quantity of liquid product to be changed in each cycle of the turret.

What is claimed is:

1. A rotary piston filler for dispensing measured liquid product into containers, comprising a container-carrying turret rotatable about an upright axis and having a source of such liquid product, the turret also having a plurality of upright pumping cylinders with pistons therein and arranged about the periphery of the turret, and the turret also having valve means at each cylinder alternately connecting the cylinder to the liquid product source and discharging liquid from the cylinder to an adjacent container, the piston of each cylinder having substantially vertical reciprocation, driving means producing vertical reciprocation of the pistons of the cylinders and including elongate stationary circumferential cam means embracing the rotary turret and undulating axially thereof, vertically movable drive arms and stationary vertical guide means on the turret for the arms and adjacent each of the cylinders, the drive arms having follower means engaging the cam means to be vertically reciprocated thereby as the turret revolves, the drive means also including drive rods connected to the pistons to produce vertical reciprocation thereof, and each of the drive arms and the adjacent drive rod having adjustable lost motion connecting means producing variable vertical reciprocation of the rod in response to the vertical reciprocation of the drive arm, the rod having a reduced magnitude of vertical movement as compared to the vertical movement of the arm.

2. The rotary piston filler according to claim 1 and the lost motion connecting means having a slide vertically movable between two spaced stops.

3. The rotary piston filler according to claim 2 and one of said stops being adjustable toward and away from the other of the stops, there being releasable means for locking the adjustable stop in any of a plurality of positions.

4. The rotary piston filler according to claim 1 and the lost motion connecting means including a slide and a guide movable vertically with respect to each other, one of said slide and guide embracing the other to prevent relative movement therebetween transversely to said vertical movement, and one of said slide and guide also having a pair of vertically spaced stops limiting the relative movement between the slide and guide.

5. The rotary piston filler according to claim 1 wherein said lost motion connecting means between each of said drive arms and the adjacent drive rod including coupling portions on the arm and rod, respectively, one of said coupling portions having a vertically oriented opening through which the other coupling portion extends for relative vertical movement, and one of said coupling portions having a pair of stops limiting relative vertical movement between the rod and arm.

6. The rotary piston filler according to claim 5 wherein one of said coupling portions comprises a vertically oriented stem on the rod, and the other of the coupling portions comprises an end portion of the arm with a vertical bore therethrough slidably receiving said stem for limited relative vertical movement between the drive rod and the drive arm.

7. The rotary piston filler according to claim 6 wherein said pair of stops include a shoulder on the rod adjacent the stem, and a nut threaded onto the stem and confronting the shoulder and confining the end portion of the arm therebetween.

8. The rotary piston filler according to claim 7 and said nut being movable between a first position wherein the nut bears with significant pressure against the end portion of the arm to clamp the arm against the shoulder of the rod and prevent relative vertical movement between the rod and arm, and a second position spaced from the end portion of the arm to permit relative vertical movement between the arm and rod during reciprocation of the piston.

9. A rotary piston filler for dispensing measured liquid product into containers, comprising a container-carrying turret rotatable about an upright axis and having a source of such liquid product, the turret also having a plurality of upright pumping cylinders with pistons therein and arranged about the periphery of the turret, and the turret also having valve means at each cylinder alternately connecting the cylinder to the liquid product source and discharging liquid from the cylinder to an adjacent container, the piston of each cylinder having substantially vertical reciprocation, driving means producing vertical reciprocation of the pistons of the cylinders and including elongate stationary circumferential cam means embracing the rotary turret and having an undulating shape in an axial direction of the turret, the drive means including vertically movable drive arms and stationary vertical guide means on the turret for guiding the arms in vertical reciprocation and adjacent the cylinders, the drive arms having cam follower means engaging the cam means for following the undulating shape thereof and producing vertical reciprocation of the arms as the turret is revolved, the drive means also including drive rods connected to the pistons and extending upwardly therefrom to produce vertical reciprocation of the piston, each of the drive rods having an upper portion with an upstanding stem thereon, the stem of each of the rods having an upper threaded portion with a nut threaded thereon, the drive rod also having a shoulder adjacent the stem and confronting the nut to cooperate therewith in defining opposed and spaced stops, the drive arm having an upper end with a bore therethrough receiving the stem in slidable relation, the upper end of the drive arm engaging one of the stops defined by the shoulder and nut, and locking means retaining the nut in predetermined position on the stem.

* * * * *

UNITED STATES PATENT AND TRADEMARK OFFICE

CERTIFICATE OF CORRECTION

PATENT NO. : 4,244,404

DATED : January 13, 1981

INVENTOR(S) : Bruce A. Brockner et al

It is certified that error appears in the above-identified patent and that said Letters Patent is hereby corrected as shown below:

On the title page, Assignee should read:

-- Nordson Corporation, Amherst, Ohio --.

Signed and Sealed this

*Third* Day of *August 1982*

[SEAL]

*Attest:*

GERALD J. MOSSINGHOFF

*Attesting Officer* *Commissioner of Patents and Trademarks*